US006125946A

United States Patent [19]

Chen

[11] Patent Number: 6,125,946

[45] Date of Patent: Oct. 3, 2000

[54] PERFORATING GUN

[75] Inventor: Kuo-Chiang Chen, Sugar Land, Tex.

[73] Assignee: Schlumberger Technology Corporation, Sugar Land, Tex.

[21] Appl. No.: 09/168,800

[22] Filed: Oct. 8, 1998

[51] Int. Cl.[7] ..... E21B 43/116; E21B 7/00

[52] U.S. Cl. ..... 175/4.53; 166/55

[58] Field of Search ..... 175/4.6, 4.53; 166/297, 55; 89/1.15; 102/310

[56] References Cited

U.S. PATENT DOCUMENTS

| | | | |
|---|---|---|---|
| 2,947,253 | 8/1960 | Cirilo | 175/4.53 |
| 2,974,589 | 3/1961 | Bryan | 175/4.53 |
| 3,018,730 | 1/1962 | Castel | 120/310 |
| 4,844,167 | 7/1989 | Clark | 175/4.6 |
| 5,095,801 | 3/1992 | Lopez De Cardenas | 175/4.53 |

*Primary Examiner*—Thomas B. Will
*Assistant Examiner*—Meredith C Petravick
*Attorney, Agent, or Firm*—Trop Pruner & Hu P.C.

[57] ABSTRACT

A perforating gun includes a guide, a first charge unit, a second charge unit and a linkage. The first and second charge units are coupled to the guide. The second charge unit is capable of being in a collapsed position for passing the second charge unit through a tubing and is capable of being in an expanded position for detonating the second charge unit. The linkage is connected to the second charge unit to communicate an applied force to cause the second charge unit to move the second charge unit along the guide toward the first charge unit when the second charge unit is at least partially in the expanded position.

30 Claims, 7 Drawing Sheets

PERFORATING GUN

BACKGROUND

The invention relates to a perforating gun.

For purposes of causing well fluid to flow from a producing formation into a well, a perforating gun may be lowered downhole into the well and detonated to pierce a casing (of the well) and form fractures in the formation. After the perforating gun detonates, well fluid typically flows into the casing and to the surface of the well via a production tubing that is located inside the casing. A seal typically is formed (by a packer, for example) between the inside of the casing and the exterior of the production tubing, and the well fluid enters the production tubing from beneath this seal.

The production tubing typically is set in place before the perforating gun is lowered downhole. As a result, the perforating gun must be lowered down through the central passageway of the production tubing to access a lower section of the well casing (beneath the production tubing) for purposes of piercing the casing and forming the fractures. Therefore, at least when passing through the production tubing, the maximum cross-sectional diameter of the perforating gun is limited by the inner diameter of the production tubing.

The size restriction imposed by the production tubing may limit the size of shaped charges (i.e., the high explosives) of the perforating gun unless the gun has a mechanism to cause the longitudinal axes of the shaped charges to become aligned with the longitudinal axis of the production tubing when the charges pass through the tubing. After passing through the production tubing, the mechanism may radially expand, or deploy, the charges. Therefore, if the gun does not include this alignment mechanism, the size restrictions imposed by the inner diameter of the production tubing may limit the size and thus, the amount of explosives that are placed downhole.

Besides maximizing the amount of explosives that are lowered downhole, the performance of the perforating gun may be enhanced in other ways. As an example, performance of the perforating gun may be enhanced by minimizing a radial standoff distance between the charges and the portion of the casing where perforation occurs. However, the radial deployment of the charges (after passing through the production tubing) typically reduces the standoff distances. As another example, performance of the perforating gun may be enhanced by increasing the shot density (i.e., decreasing the distance between adjacent charges) of the perforating gun.

As an example of the many different types of perforating guns, in one type of perforating gun (often called an "Enerjet gun"), charges are secured to a loading strip. For example, the charges may be secured to recesses of the loading strip by support rings. The cross-sectional diameter of the Enerjet gun is equal to or smaller than the inner diameter of a production tubing. However, the charges of the Enerjet gun are not radially deployed after passing through the production tubing, but rather, the charges are permanently fixed in radially outward directions. As a result, the longitudinal dimension of each charge, the standoff distances and the amount of explosives of the gun are limited by the inner diameter of the production tubing. Furthermore, the Enerjet gun does not include a mechanism to increase the shot density of the gun once the gun passes through the production tubing. In a second type of perforating gun (often called a "Hyperdome gun") similar in some aspects to the Enerjet gun, shaped charges arc packaged in a hollow carrier tubing that has an outer diameter which is smaller than the inner diameter of the production tubing. However, the Hyperdome gun typically has the same limitations as the Enerjet gun.

In a third type of gun (often called a "Pivot gun"), charges are connected to a carrier tubing and are radially deployed after being run through the production tubing. While being run through the production tubing, the longitudinal axes of the charges are aligned with a longitudinal axis of the production tubing, and as a result, for purposes of running the gun downhole, the cross-sectional diameter of the Pivot gun is smaller than or equal to the inner diameter of the production tubing. During deployment of the charges, sets of linkages rotate the charges in radially outward directions to their shooting positions. Therefore, the Pivot gun has a mechanism to deploy and orient charges to fulfill the purposes of increasing charge sizes and decreasing standoff distances. However, the Pivot gun does not include a mechanism to increase the shot density of the gun after deployment of the charges. In another type of perforating gun (often called a "Swingjet gun"), charges are connected to a carrier tube and deployed in a similar manner to the Pivot gun. Similar to the Pivot gun, the Swingjet gun does not have a mechanism to increase the shot density of the gun after the charges are deployed.

In a fifth type of perforating gun, charges arc connected to each other at their two ends, instead of being connected to a carrier tube. A connecting bar is filled with an explosive that transfers a detonation from charge to charge. Two cables are used to set the position of the bottom charge. Once this is done, the positions of the rest of the charges are set by gravity. However, because of this type of gravity-induced mechanism, the perforating gun may only be used in vertical or near-vertical wells.

Thus, there is a continuing need for a perforating gun that minimizes the distances between deployed charges regardless of the spatial orientation of the gun.

SUMMARY

Generally, in one embodiment, a perforating gun includes a guide, a first charge unit, a second charge unit and a linkage. The first and second charge units are coupled to the guide. The second charge unit is capable of being in a collapsed position for passing the second charge unit through a tubing and is capable of being in an expanded position for detonating the second charge unit. The linkage is connected to the second charge unit to communicate an applied force to the second charge unit to move the second charge unit along the guide toward the first charge unit when the second charge unit is at least partially in the expanded position.

Generally, in another embodiment, a method includes changing a first charge unit from a collapsed position for passing through a tubing to an expanded position for detonating the first charge unit. A force is applied to decrease a distance between the first charge unit and a second charge unit during the changing.

Other embodiments will become apparent from the following description, from the drawings and from the claims.

DETAILED DESCRIPTION

Figure 1:
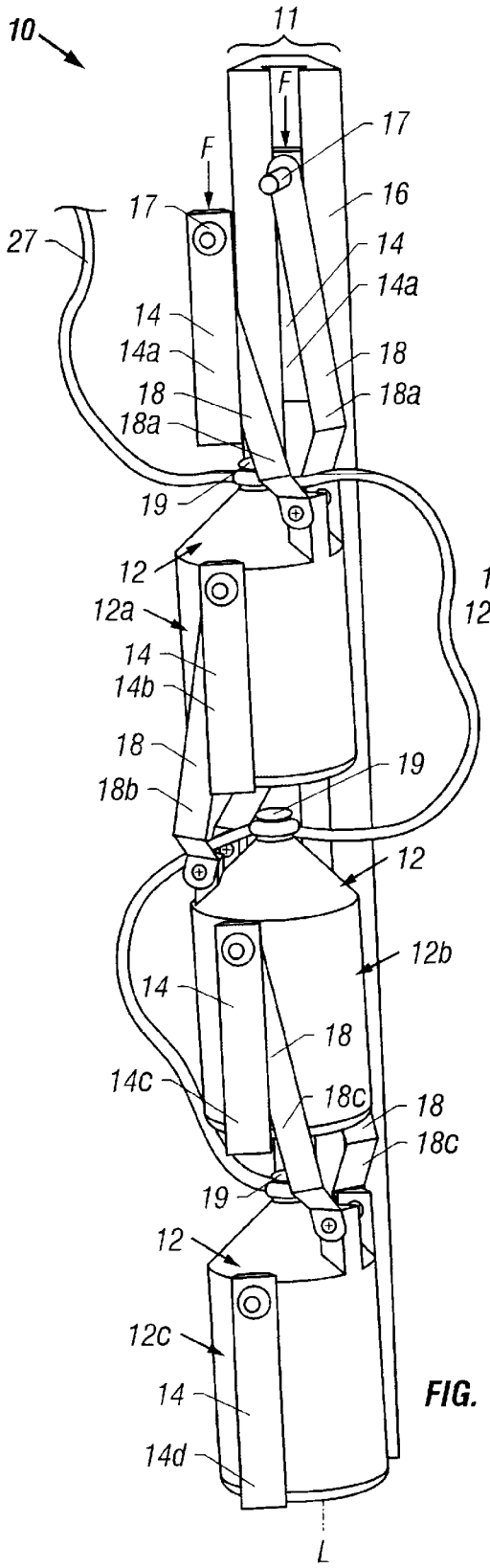
FIG. 1 is a side view of a perforating gun according to one embodiment of the invention before deployment of capsule charges.

Referring to FIG. 1, an embodiment 10 of a perforating gun in accordance with the invention includes encased shaped charge units, or capsule charges 12 (capsule charges 12*a*, 12 *b* and 12*c*, as examples). In their collapsed positions, the longitudinal axes of the capsule charges 12 are substantially aligned with a longitudinal axis L of the perforating gun 10 (as shown in FIG. 1) for purposes of running the perforating gun 10 through a production tubing (not shown). However, after the perforating gun 10 passes through the production tubing, the charge capsules 12 may be radially deployed into expanded positions in which the charge capsules 12 substantially radially extend away from the longitudinal axis L and toward the inner surface of a well casing (not shown). As described below, a sliding mechanism that operates independently of the orientation of the perforating gun 10 responds to a longitudinal force F (that is substantially directed along the longitudinal axis L) to decrease the distances between adjacent capsule charges 12 when the capsule charges 12 deploy. Thus, the shot density of the perforating gun 10 may be maximized for both substantially vertical and substantially non-vertical wells.

To accomplish the above-described features, in some embodiments, each capsule charge 12 is pivotably mounted (via associated pairs of pins 17) to a pair of parallel sliding bars 14 (the pair of sliding bars 14*a*, as an example) which allow free rotation of the capsule charge 12 relative to the sliding bars 14. Each sliding bar 14, in turn, is slidably mounted to an associated guide strip 16 (only one guide strip 16 being shown in FIG. 1) which provides guidance for longitudinal translation (along the longitudinal axis L) of the capsule charge 12. In this manner, to deploy the capsule charges 12, the longitudinal force F is communicated to the sliding bars 14 to invoke a mechanism (described below) to compress the distances between adjacent capsule charges 12 and cause the capsule charges 12 to deploy to the expanded positions, regardless of the orientation of the perforating gun 10. As an example, the longitudinal force F may be applied by a setting tool (not shown) that has members which slide into the guide bars 16 near one end 11 of the gun 10 to engage the closest pair of sliding bars 14*a* and initiate deployment of the capsule charges 12, in a manner described below.

In some embodiments, each capsule charge 12 both pivots and translates during deployment. To accomplish this, the perforating gun 10 may include pairs of linkages, or crank bars (crank bar pairs 18*a*, 18*b* and 18*c*, as examples). Each pair of crank bars 18 is connected to an associated capsule charge 12 to, when the force F is applied, cause the capsule charge 12 to pivot about the associated pair of pins 17 to move the capsule charge 12 from the collapsed to the expanded position. The pair of crank bars 18 also cause, when the force F is applied, the associated capsule charge 12 to slide along the guide strips 16 and toward an adjacent capsule charge 12.

As an example, each of the pair of crank bars 18*a* is pivotably coupled at one end to an associated capsule charge 12*a*, and at the end of the crank bar 18*a* closer to the end 11 of the perforating gun 10, the crank bar 18*a* is pivotably mounted to the sliding bar 14*a* (via one of the pins 17). The sliding bar 14*a*, in turn, is closer to the end 11 than the sliding bar 14*b* that is pivotably coupled to the associated capsule charge 12*a*. In this manner, when the longitudinal force F is communicated to the sliding bars 14*a*, the sliding bars 14*a* moves along the guide strips 16 in a direction consistent with the direction of the force F. The sliding bars 14*a* communicate the force F to the associated crank bars 18*a* which, in response, exert both longitudinal and moment forces on the associated capsule charge 12*a* to cause the capsule charge 12*a* to both pivot in a radially outward direction (to change from the collapsed to the expanded position) and move longitudinally along the guide strips 16 in a direction away from the end 11.

As described below, the other capsule charges 12 deploy in a manner similar to the capsule charge 12*a*. The communication of the longitudinal force F to the sliding bars 14*b*, 14*c* and 14*d* occurs by the action of the pairs of sliding bars 14 sliding along the guide strips 16 and contacting another pair of sliding bars 14. In this manner, when the longitudinal force F is applied, the sliding bars 14*a* slide along the guide strips 16 to contact the sliding bars 14*b*, the sliding bars 14*b* slide along the guides 16 to contact the sliding bars 14*c*, etc. As a result of this arrangement, in some embodiments, a distance (called D (see FIGS. 5 and 6)) between adjacent capsule charges 12 (and thus, the shot density of the perforating gun 10) after deployment may be set by the length of the sliding bars 14.

Because each capsule charge 12 pivots in a radially outward direction during deployment, after deployment, the radial stand-off distance between any particular capsule charge 12 and the well casing is decreased. Furthermore, after deployment, the shot density is increased because the distances between adjacent capsule charges 12 are compressed. A detonating cord 27 is held in place by retainers 19. Each retainer 19 is located on the non-jet end of an associated capsule charge 12 and prevents relative movement between the detonating cord 27 and the capsule charge 12 when the capsule charge 12 is pivoting and translating.

Figure 2:
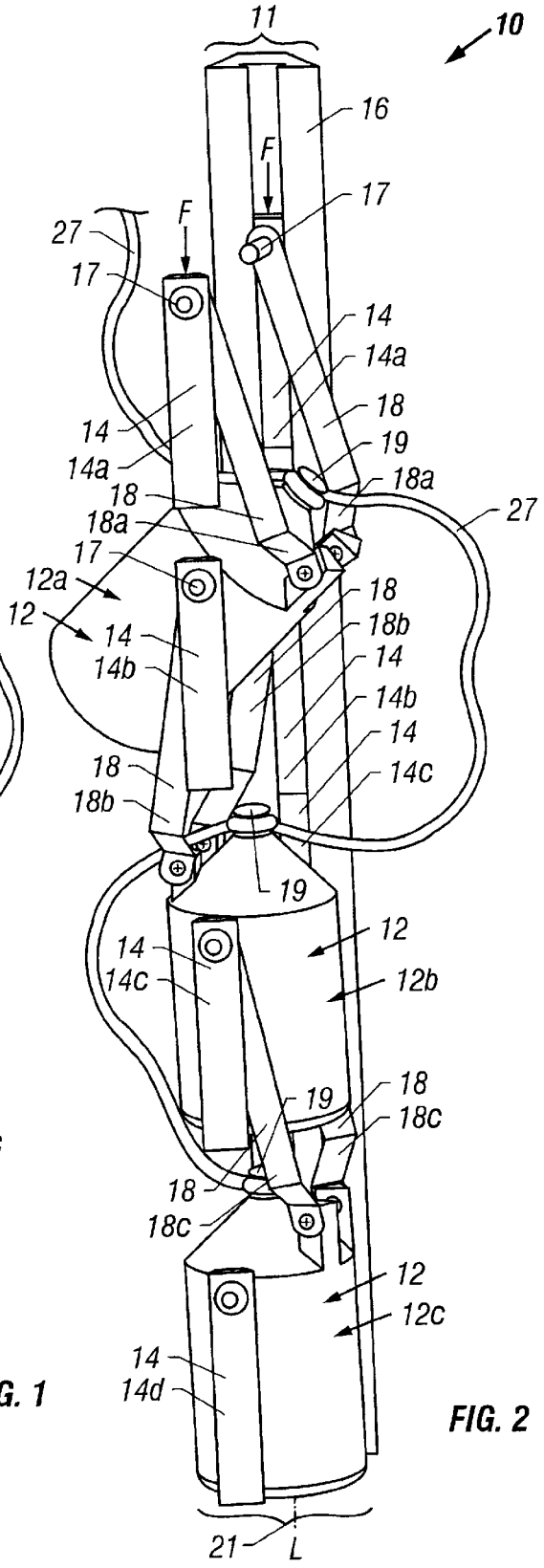
FIG. 2 is a side view of the perforating gun of FIG. 1 after partial deployment of one of the capsule charges.
Figure 3:
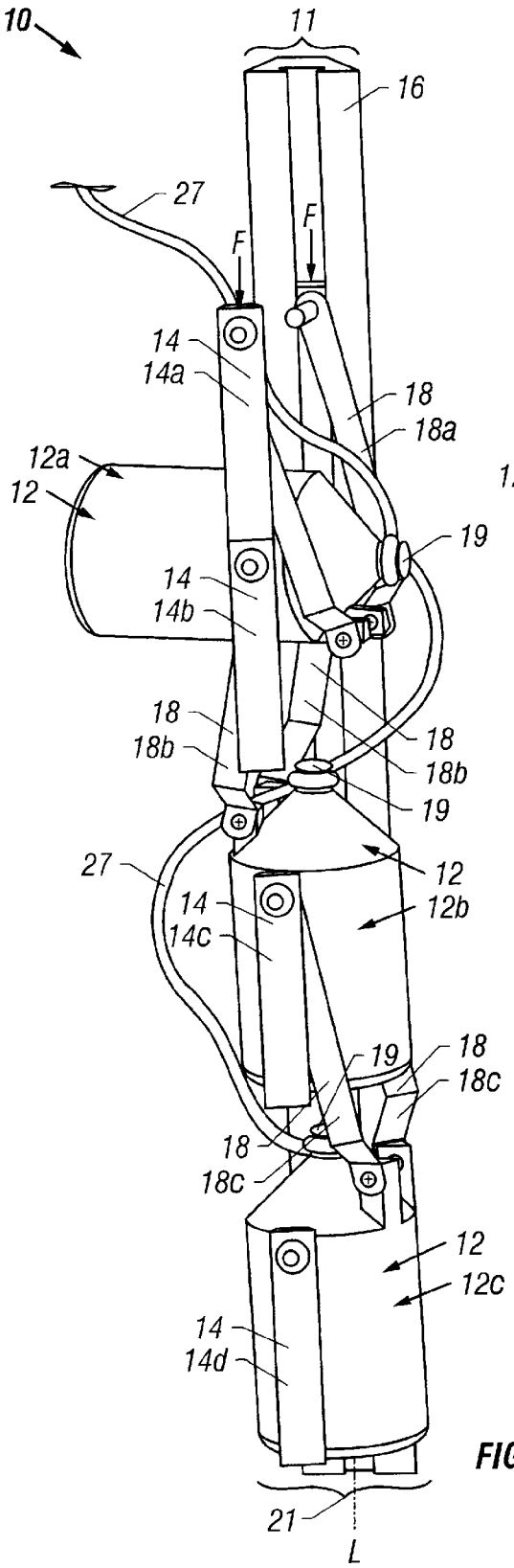
FIG. 3 is a side view of the perforating gun of FIG. 1 after full deployment of one of the capsule charges.

Referring to FIG. 2, in some embodiments, the capsule charges 12 deploy one at a time, not simultaneously. In this manner, to initiate the deployment, the setting tool applies the longitudinal force F to the pair of sliding bars 14*a* which causes the capsule charge 12*a* to start to partially deploy, or pivot, due to the moment applied by the motion of the crank bars 18*a*. The pivoting of the capsule charge 12*a* continues until the sliding bars 14*a* slide and contact the sliding bars 14*b*, as shown in FIG. 3. At this point, the deployment of the capsule charge 12*a* is complete, and the sliding bars 14*a* and 14*b* and the capsule charge 12*a* keep moving together along the guide strips 16 in a direction consistent with the longitudinal force F.

Figure 4:
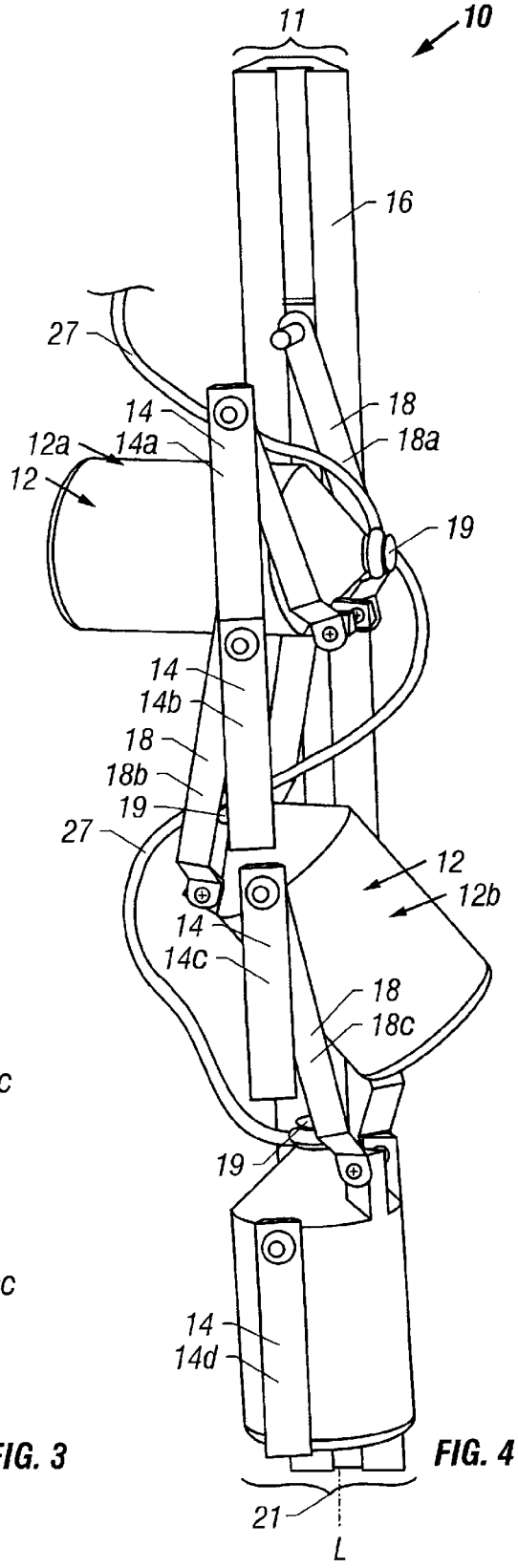
FIG. 4 is a side view of the perforating gun of FIG. 1 after full deployment of one of the capsule charges and partial deployment of another one of the capsule charges.
Figure 5:
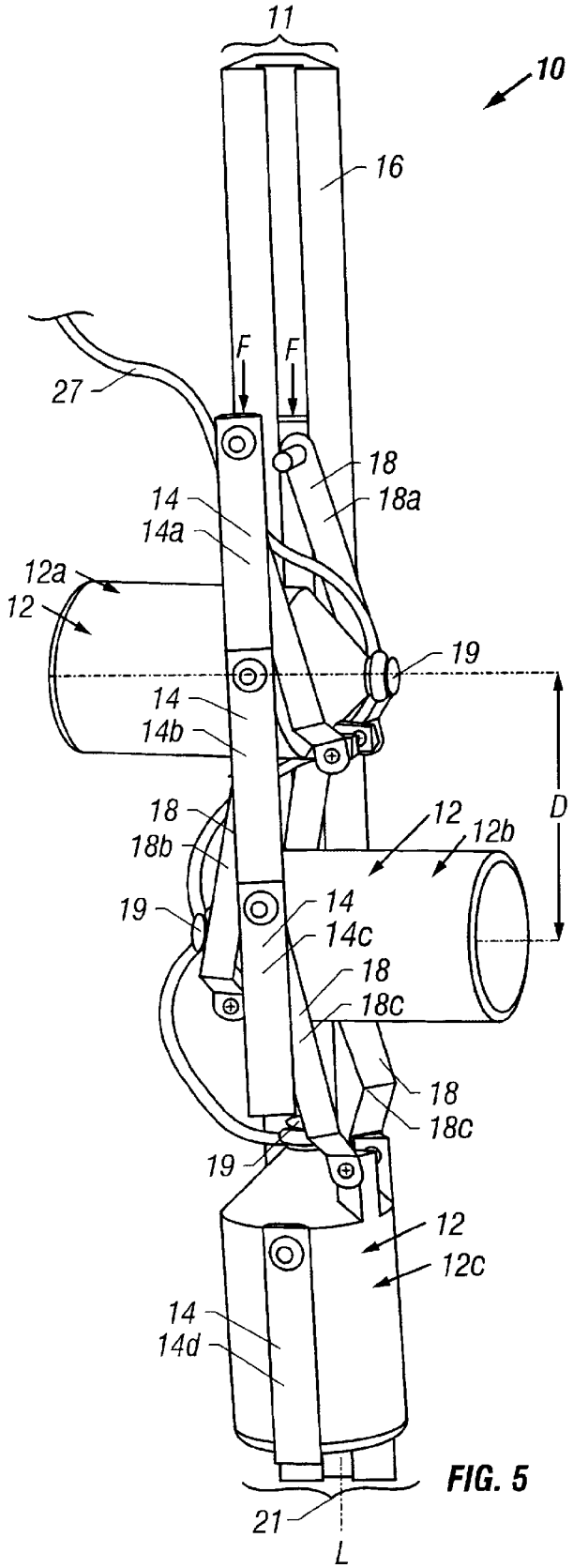
FIG. 5 is a side view of the perforating gun of FIG. 1 after full deployment of two of the capsule charges.

The capsule charge 12*a* translates longitudinally along the guide strips 16 while the crank bars 18*b* cause the adjacent capsule charge 12*b* to begin to pivot, as shown in FIG. 4. In this stage, the rotation of the capsule charge 12*b* and the compression of the distance between the capsule charges 12*a* and 12*b* occur simultaneously. This motion keeps continuing until the sliding bars 14*b* engage the lower sliding bars 14*c*, as shown in FIG. 5.

Figure 6:
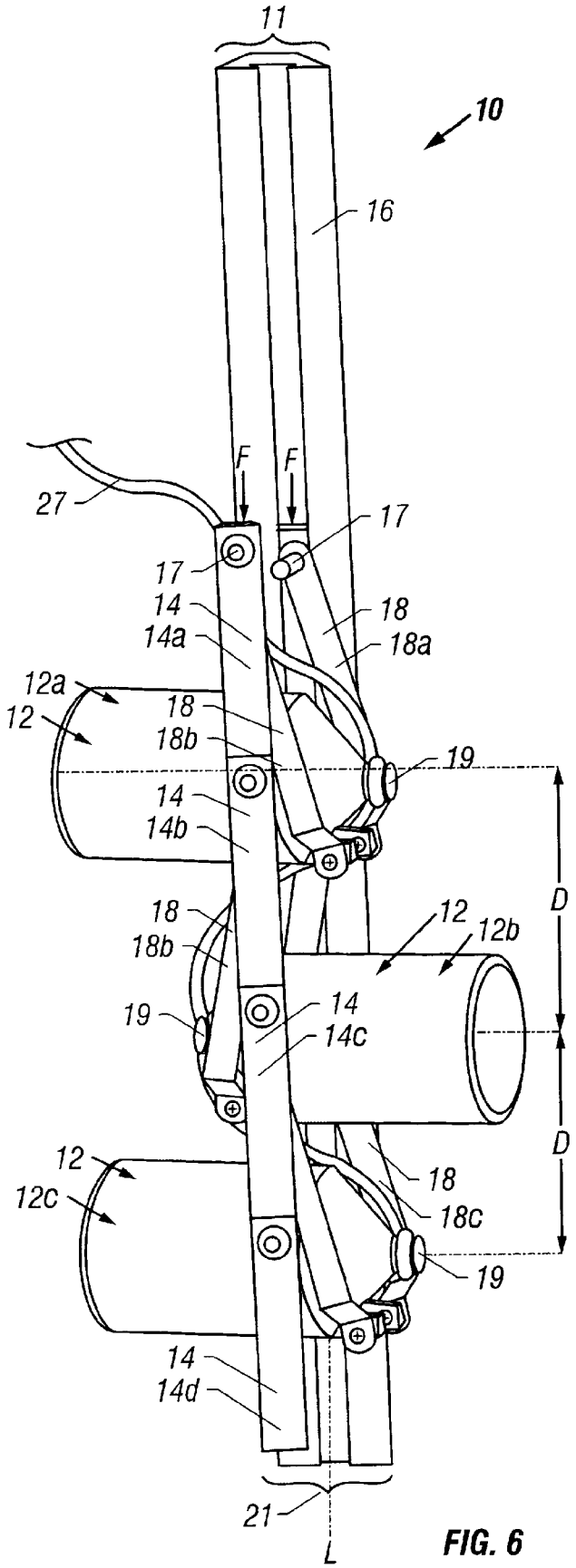
FIG. 6 is a side view of the perforating gun of FIG. 1 after full deployment of three of the capsule charges.

The rotation and translation of the capsule charges 12 propagates in a direction consistent with the direction of the longitudinal force F until the propagation reaches a bottom 21 of the guide strips 16 (and perforating gun 10), as shown in FIG. 6. At this point, all of the capsule charges 12 are oriented in their expanded positions, and the distances D between adjacent capsule charges 12 are minimized.

It may be desirable to retrieve the perforating gun 10 before detonation of the capsule charges 12. Upon this occurrence, the process described above may be reversed by applying (via the setting tool, for example) a longitudinal force in a direction opposite to the force F. Thus, the setting tool, for example, may be capable of moving in forward and backward direction, and the setting tool may have enough stroke to compensate the total compression of the charge-to-charge distance. A piston may be used to generate the required force for the setting tool by applying either hydraulic pressure from a pump or gas pressure from combustion of a propellant.

Figure 7:
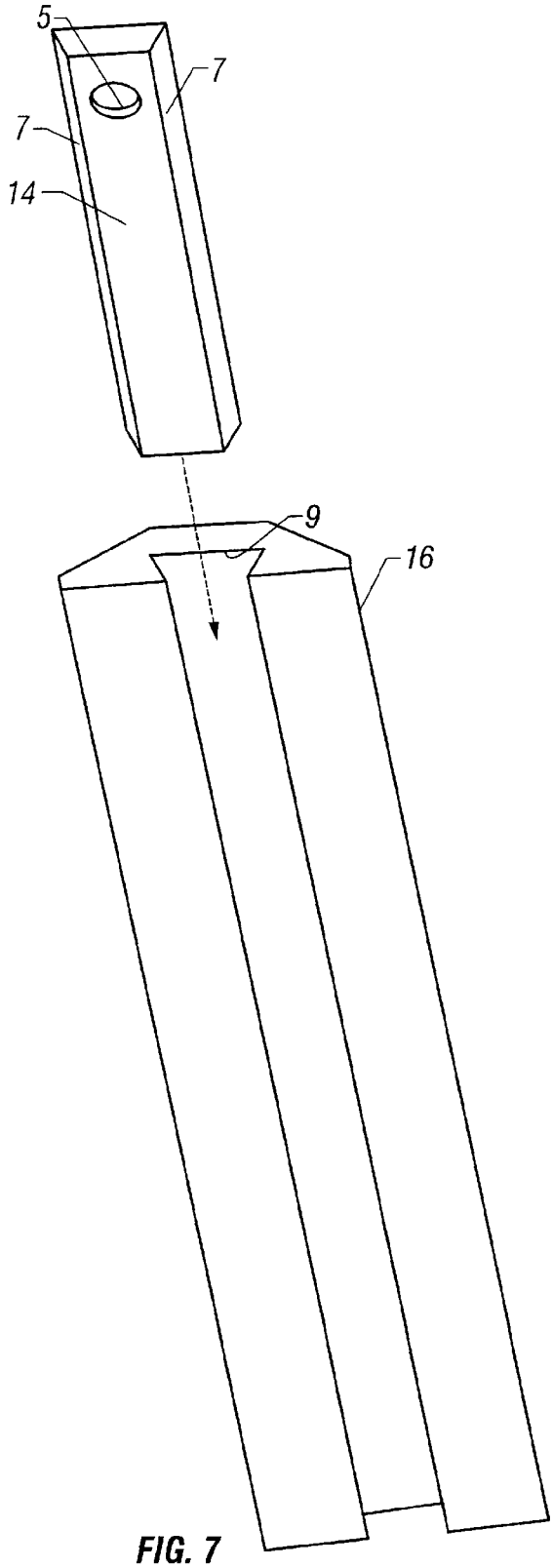
FIG. 7 is a perspective view of a guide strip and a sliding bar of the perforating gun of FIG. 1.

Referring to FIG. 7, the sliding bar 14 may have beveled edges 7 that extend along the longitudinal axis L of the perforating gun 10. In this manner, the outer profile of the sliding bar 14 may be adapted to slide within a corresponding channel 9 of the guide strip 16 to form a "tongue-in-groove" connection, and the matching beveled profile of the guide strip 16 prevents the sliding bar 14 from being pulled out of the guide strip 16.

Thus, in summary, the perforating gun 10 provides a through-tubing perforating system which may pass through a production tubing and deploy charges in an open section (below the production tubing) of a well casing; carry downhole larger capsule charges having larger longitudinal dimensions than the inner diameter of the production tubing, thus allowing more explosives to perform the perforation; and obtain higher shot density due to the compression of distances between adjacent capsule charges.

Figure 8:
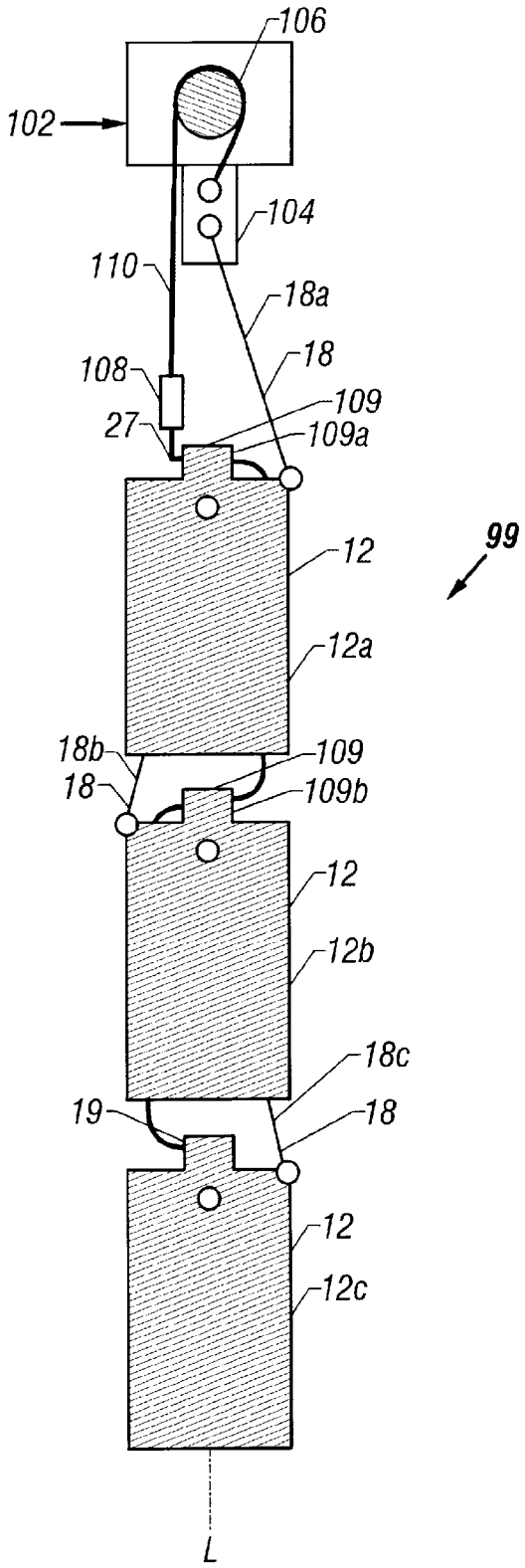
FIG. 8 is a side view of the perforating gun of FIG. 1 after deployment of the capsule charges.
Figure 9:
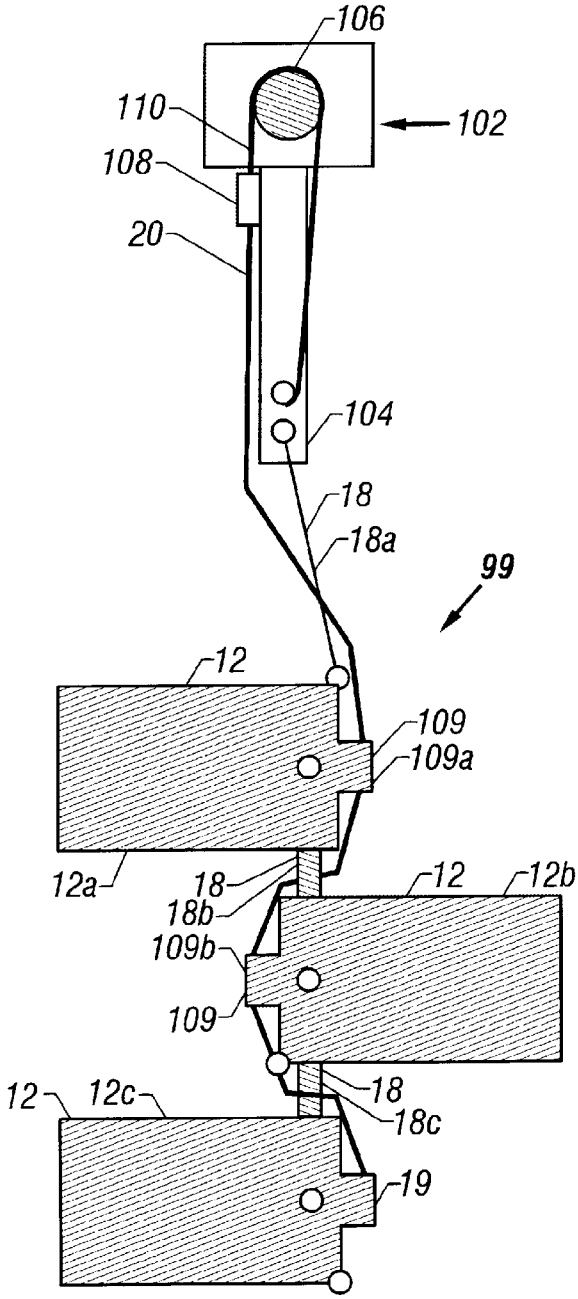
FIG. 9 is a side view of the perforating gun of FIG. 1 before deployment of the capsule charges.

Referring to FIGS. 8 and 9, in some embodiments, the perforating gun 10 may be replaced with a perforating gun 99 that is similar to the gun 10 except for a few features that permit a setting tool 102 to remove any excess slack from the detonating cord 27. In this manner, the setting tool 102 applies a tensional force to the detonating cord 27 to remove any excess slack from the detonating cord 27, regardless of the deployment positions of the charge capsules 12. Due to the removal of the excess slack, the detonating cord 27 more effectively propagates a shockwave, and thus, performance of the perforating gun 99 may be enhanced.

To accomplish the above-described features, a wireline 110 rests on and partially circumscribes a pulley 106 of the setting tool 102. A portion of the wireline 110 is secured to a movable member 104 of the tool 102, and an end of the wireline 110 is coupled (via a detonator 108, such as a blasting cap) to the detonating cord 27.

The setting tool 102 moves the member 104 along the longitudinal axis L of the perforating gun 99 to contact the sliding bars 14*a* and deploy the capsule charges 12. In this manner, when the member 104 moves, the member 104 exerts a force on the wireline 110 which, due to the redirection of the force by the pulley 106, exerts a force on the detonating cord 27 to remove any excess slack in the cord 27. Therefore, when the charge capsules 12 are deployed, the detonating cord 27 remains tight as shown in FIG. 9. Unlike the perforating gun 10, the retainers 19 that are secured to the capsule charges 12*a* and 12*b* of the gun 99 are replaced by rings 109 which serve as guides and allow the detonating cord 27 to pass through the rings 109. The retainer 19 that is secured to the capsule charge 12*c* secures the end of the detonating cord 27 to the charge capsule 12*c*.

Figure 10:
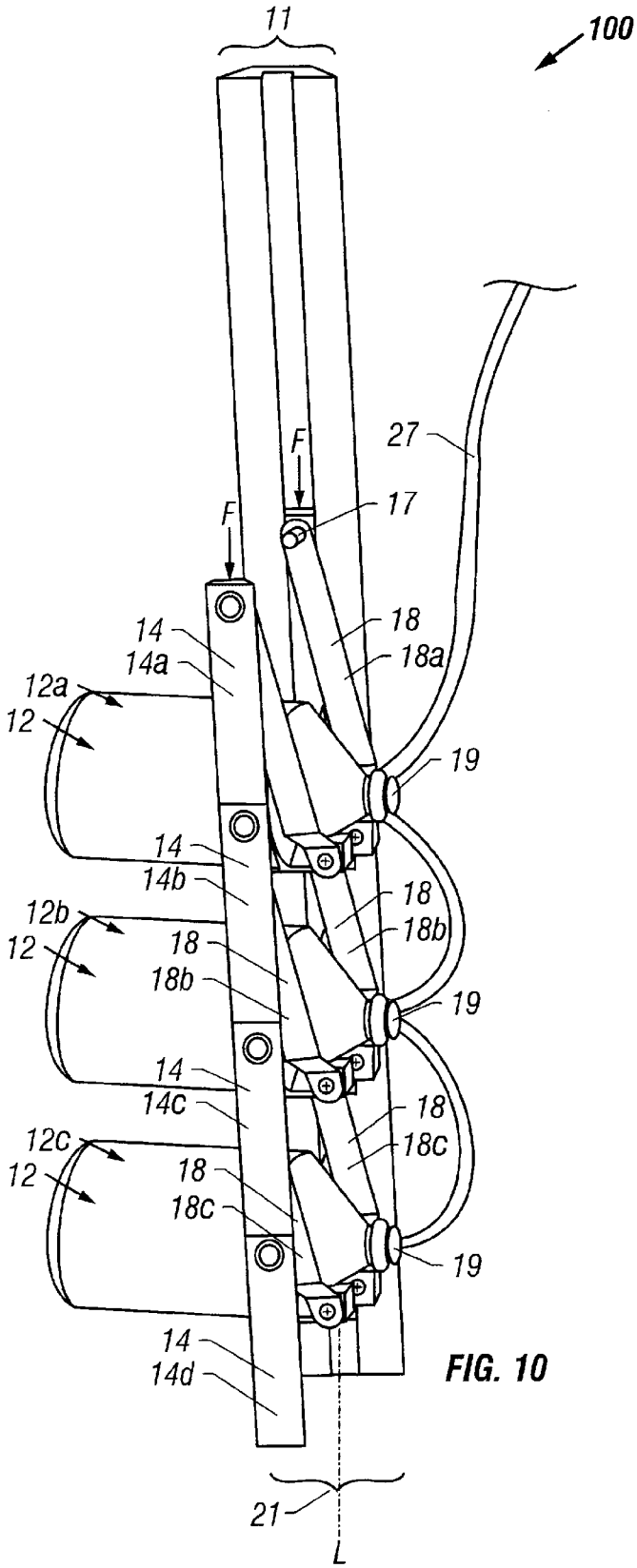
FIG. 10 is a side view of a perforating gun according to another embodiment of the invention.

Other embodiments are within the scope of the following claims. For example, the perforating gun 10, (as shown in FIGS. 1–6) uses 180° phasing in which adjacent capsule charges 12 are oriented, after deployment, in substantially radially opposed directions. However, as an example, in other embodiments, a perforating gun 100 (see FIG. 10) in accordance with the invention may employ 0° phasing in which adjacent capsule charges 12 are oriented, after deployment, in substantially radially aligned directions. Other perforating guns that have different phasing schemes are possible. As another example, in different embodiments, the perforating gun may have more or less than three capsule charges. As yet another example, the one-piece linkage provided by the crank bar 18 might be replaced by a linkage that includes more than one piece.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A perforating gun comprising:

a guide;

a first charge unit coupled to the guide;

a second charge unit coupled to the guide, the second charge unit capable of being in a collapsed position for passing the second charge unit through a tubing and capable of being in an expanded position for detonating the second charge unit; and a linkage connected to the second charge unit to communicate an applied force to the second charge unit to move the second charge unit along the guide toward the first charge unit when the second charge unit is at least partially in the expanded position.

2. The perforating gun of claim 1, wherein the linkage is further connected to communicate the applied force to the second charge unit to cause the second charge unit to change from the collapsed position to the expanded position.

3. The perforating gun of claim 2, wherein the linkage is further connected to concurrently cause the second charge unit to move along the guide toward the first charge unit and change from the collapsed position to the expanded position.

4. The perforating gun of claim 1, wherein the linkage comprises a crank bar.

5. The perforating gun of claim 1, further comprising:

at least one pin to pivotably couple the linkage to the second charge unit.

6. The perforating gun of claim 1, further comprising:

at least one pin to pivotably couple the second charge unit to the guide.

7. The perforating gun of claim 6, wherein the linkage is connected to pivot the second charge unit about said at least one pin to change the second charge unit from the collapsed position to the expanded position.

8. The perforating gun of claim 1, wherein the linkage is slidably connected to the guide.

9. The perforating gun of claim 1, wherein the collapsed position comprises a position where a longitudinal axis of the second charge unit is substantially aligned with a longitudinal axis of the gun.

10. The perforating gun of claim 1, wherein the expanded position comprises a position where a longitudinal axis of the second charge unit is substantially orthogonal to a longitudinal axis of the gun.

11. The perforating gun of claim 1, wherein the second charge unit is slidably connected to the guide.

12. The perforating gun of claim 1, wherein the first charge unit is capable of being in a collapsed position for passing the first charge unit through the tubing and in an expanded position for detonating the first charge unit.

13. The perforating gun of claim 12, further comprising:

another linkage connected to the first charge unit to communicate the force to the first charge unit to cause the first charge unit to change from the collapsed position to the expanded position.

14. The perforating gun of claim 1, further comprising:

a ring on the first charge unit to releasably guide a detonating cord through the first charge unit.

15. A method usable with a first charge unit and a second charge unit that are both slidably connected to a guide the method comprising:

changing the first charge unit from a collapsed position for passing the first charge unit through a tubing to an expanded position for detonating the first charge unit; and during the act of changing, applying force on the first charge unit to move the first charge unit along the guide to decrease a distance between the first charge unit and the second charge unit.

16. The method of claim 15, wherein the collapsed position comprises a position where a longitudinal axis of the first charge unit is substantially aligned with a longitudinal axis of a perforating gun.

17. The method of claim 15, wherein the expanded position comprises a position where a longitudinal axis of the first charge unit is substantially orthogonal to a longitudinal axis of a perforating gun.

18. The method of claim 15, further comprising:

changing the second charge unit from a collapsed position for passing the second charge unit through the tubing to an expanded position for detonating the second charge unit.

19. The method of claim 18, wherein the act of changing the first charge unit occurs at least partially before the act of changing the second charge unit.

20. The method if claim 15, wherein the act of changing comprises:

pivoting the first charge unit.

21. A perforating gun comprising:

a guide;

a first charge unit coupled to the guide;

a second charge unit coupled to the guide, the second charge unit capable of being aligned with the guide and capable of rotating away from the guide; and a linkage connected to the second charge unit to communicate an applied force to the second charge unit to cause the second charge unit to rotate away from the guide and move toward the first charge unit.

22. The perforating gun of claim 21, wherein the linkage is further connected to communicate the applied force to the second charge unit to cause the second charge unit to change from a collapsed position to an expanded position.

23. The perforating gun of claim 21, wherein the linkage is further connected to concurrently cause the second charge unit to move along the guide toward the first charge unit and rotate.

24. The perforating gun of claim 21, wherein the linkage comprises a crank bar.

25. The perforating gun of claim 21, further comprising:

at least one pin to pivotably couple the linkage to the second charge unit.

26. The perforating gun of claim 21, wherein a longitudinal axis of the second charge unit is substantially aligned with a longitudinal axis of the gun when the second charge unit is aligned with the guide.

27. The perforating gun of claim 21, wherein the linkage is connected to cause the second charge unit to rotate to a position where a longitudinal axis of the second charge unit is substantially orthogonal to a longitudinal axis of the gun in response to the applied force.

28. A method usable with a first charge unit and a second charge unit that are both slidably connected to a guide, the method further comprising:

changing the first charge unit from a first position in which the first charge unit is aligned with the guide to a second position in which the first charge unit is substantially orthogonal to the guide; and during the act of changing, applying force on the first charge unit to move the first charge unit along the guide and decrease a distance between the first charge unit and the second charge unit.

29. The method of claim 28, wherein a longitudinal axis of the first charge unit is substantially aligned with a longitudinal axis of a perforating gun when the first charge unit is aligned with the guide.

30. The method of claim 28, wherein a longitudinal axis of the first charge unit is substantially orthogonal to a longitudinal axis of a perforating gun when the first charge unit is orthogonal to the guide.

* * * * *